US007125273B2

(12) United States Patent
Irwin et al.

(10) Patent No.: US 7,125,273 B2
(45) Date of Patent: Oct. 24, 2006

(54) DETACHABLE POWER CORD APPARATUS

(75) Inventors: Michael F. Irwin, So. Barrington, IL (US); Raymond Leung Wai Tat, Shatin (HK); Benny Wong Wai Kwong, Tuen Mun (HK)

(73) Assignee: Advance Thermo Control, Ltd., Tsuen Wan (HK)

( * ) Notice: Subject to any disclaimer, the term of this patent is extended or adjusted under 35 U.S.C. 154(b) by 0 days.

(21) Appl. No.: 10/863,690

(22) Filed: Jun. 8, 2004

(65) Prior Publication Data

US 2005/0272293 A1 Dec. 8, 2005

(51) Int. Cl.
*H01R 13/62* (2006.01)
*H01R 13/625* (2006.01)

(52) U.S. Cl. ..... 439/180; 439/348

(58) Field of Classification Search ..... 439/180, 439/348, 362

See application file for complete search history.

(56) References Cited

U.S. PATENT DOCUMENTS 3,899,765 A 8/1975 Daigneault, Jr.
4,107,638 A 8/1978 Hollweck
4,270,067 A 5/1981 Thomas et al.
4,610,496 A * 9/1986 Schwartz et al. ..... 439/348
6,364,675 B1 * 4/2002 Brauer et al. ..... 439/348
6,607,391 B1 8/2003 Mendelson et al.
6,796,827 B1 * 9/2004 Chen ..... 439/348

FOREIGN PATENT DOCUMENTS

CA 2287035 4/2001

* cited by examiner

*Primary Examiner*—Briggitte R. Hammond
(74) *Attorney, Agent, or Firm*—Boyle Fredrickson Newholm Stein & Gratz S.C.

(57) ABSTRACT

A connection device is provided for operatively connecting a temperature control for an electrical appliance to a power source. The connection device includes first and second connection surfaces projecting from the temperature control that partially define a cavity. Each connection surface includes a corresponding depression formed therein. A power cord housing supports a first end of a power cord. The power cord housing includes a forward end that is receivable in the cavity. The connection device further includes first and second detent elements that are movable between first extended positions wherein the detent elements project from the power cord housing and are receivable in corresponding depressions and second retracted positions. Biasing structure is provided for urging the first and second detent elements toward their extended positions.

23 Claims, 3 Drawing Sheets

DETACHABLE POWER CORD APPARATUS

FIELD OF THE INVENTION

This invention relates generally to cooking devices, and in particular, to a detachable power cord apparatus for detachably connecting an electrical appliance to a power supply.

BACKGROUND AND SUMMARY OF THE INVENTION

As is known, electrical appliances such as deep fryers and electric frying pans are often used by individuals in the preparation and cooking of meals. These electrical appliances typically include a power cord that is receivable within a corresponding electrical outlet for supplying electrical power to the appliance. It can be appreciated that by utilizing a power cord to supply electrical power to the appliance, such cord may constitute a potential hazard to those parties in close proximity thereto. For example, each year a substantial number of children may tip over an electrical appliance by inadvertently engaging its power cord. In appliances that utilize oil or other fluids that have elevated temperatures, the accidental tipping of such electrical appliance may result in significant injury to a party in close proximity to the appliance.

In certain electrical appliances such as electric frying pans, thermostatic control devices are utilized to insure that the cooking surface of the electrical appliance is maintained at a proper temperature. Typically, these thermostatic control devices include a temperature probe which is removably attached to the electrical appliance by insertion into a female receiver. This, in turn, allows the thermostatic control device to be separated from the electrical appliance thereby allowing the electrical appliance to be immersed in water for cleaning. In order to minimize the risks associated with utilizing a power cord with such electrical appliances, the thermostatic control device is usually connected to a power source by a detachable power cord. Current Underwriters Laboratories, Inc. (UL) standards require that the force required to separate the power cord from the thermostatic control device shall be at least 5% less than the force required to overcome the static friction of the electrical appliance on a supporting surface such as a countertop or the like. Consequently, various detachable power cord devices have been developed that meet the present UL standards and that provide electrical power to appliances that utilize thermostatic control devices.

By way of example, Mendelson et al, U.S. Pat. No. 6,607,391 discloses various embodiments of a detachable power supply apparatus for use with electrical appliances. The electrical appliance includes a removable temperature control device having a mounting panel incorporating a ferrous contact plate and a pair of conductive pins extending therefrom. The power supply cord includes a female electrical receptacle for receiving the pair of conductive pins extending from the mounting panel. In addition, the female electrical receptacle may incorporate a magnet subassembly that is directed toward the ferrous contact plate of the mounting panel for maintaining the electrical connection between the conductive pins and the female electrical receptacle. It is intended that the arrangement require a predetermined tensile or pulling force and a preselected shearing or lateral force to overcome the magnetic force generated by the magnet subassembly in order to allow a user to disengage the female electrical receptacle from the mounting panel of the temperature control device.

While functional for its intended purpose, the detachable power supply apparatus disclosed in the '391 patent has certain limitations. By way of example, the magnetic force generated by the magnet subassembly of the power supply cord may vary. As a result, the preselected tensile or shearing force required to disconnect the power supply cord from the temperature control device may inadvertently fail to meet the present UL standard. Alternatively, the magnetic force provided by the magnet subassembly may be insufficient to insure proper electrical contact between the pair of conductive ends of the temperature control device and the female electrical receptacle of the power supply cord thereby rendering the detachable power supply apparatus ineffective for its intended purpose. Further, incorporating the magnet subassembly into the power supply apparatus increases to overall cost of the electric frying pan.

Therefore, it is a primary object and feature of the present invention to provide a detachable power cord apparatus that may be utilized to interconnect an electrical appliance or a temperature control device to a power source.

It is a further object and feature of the present invention to provide a detachable power cord apparatus for use with an electrical appliance or a temperature control device therefore that may be detached from the appliance or the temperature control device in response to a predetermined lateral force or a predetermined shear force thereon.

It is a further object and feature of the present invention to provide a detachable power cord apparatus for use with an electrical appliance or a temperature control unit that is inexpensive to manufacture and simple to utilize.

In accordance with the present invention, a connection device is provided for operatively connecting a temperature control housing of an electrical appliance to a power source. The connection device includes upper and lower spaced connection surfaces projecting from the control housing and defining a cavity therebetween. The upper and lower connection surfaces include corresponding catches axially aligned with each other. A power cord housing supports a first end of a power cord. The power cord housing has upper and lower surfaces and a forward end receivable between the upper and lower connection surfaces. A first detent element is movable between a first extended position wherein the first detent element projects from the power cord housing and is receivable in one of the catches and a second retracted position.

The connection device may also include a second detent element movable between a first extended position wherein the second detent element projects from the power cord housing and is receivable in the other of the catches and a second retracted position. It is contemplated for the first and second detent elements to take the form of ball bearings. In its extended position, the first detent element projects from the upper surface of the power cord housing. In its extended position, the second detent element projects from the lower surface of the power cord housing. A means is provided for biasing the first and second detent element toward their extended positions. The means for biasing the first and second detent elements may include a spring extending therebetween.

In accordance with a further aspect of the present invention, a connection device is provided for operatively connecting a temperature control housing for an electrical appliance to a power source. The connection device includes first and second connection surfaces that project from the control housing and that partially define a cavity. Each connection surface includes a corresponding depression therein. A power cord housing supports a first end of a power cord. The power cord housing has first and second surfaces and a forward end receivable within the cavity. A first detent element is movable between a first extended position wherein the first detent element projects from the power cord housing and is receivable in the depression in the first connection surface and a second retracted position. A second detent element is movable between a first extended position wherein the second detent element projects from the power cord housing and is receivable in the depression in the second connection surface and a second retracted position.

It is contemplated for the first and second surfaces to be generally parallel to each other and for the first and second detent elements to include ball bearings. In its extended position, the first detent element projects from the first surface of the power cord housing. In its extended position, the second detent element projects from the second surface of the power cord housing. Means are provided biasing the first and second detent elements toward their extended positions. Preferably, the means for biasing the first and second detent elements includes a spring extending therebetween.

In accordance with a still further aspect of the present invention, a connection device is provided for operatively connecting an electrical appliance to a power source. The connection device includes a temperature control device having leading and trailing ends. The temperature control device has first and second connection surfaces projecting from the trailing end to partially define a cavity. Each connection surface includes a corresponding depression therein. A power cord housing supports a first end of a power cord. The power cord housing has first and second surfaces and a forward end receivable in the cavity partially defined by the connection surfaces of the temperature control device. A first detent element is movable between a first extended position wherein the first detent element projects from the power cord housing and is receivable in the depression in the first connection surface and a second retracted position. A second detent element is movable between a first extended position wherein the second detent element projects from the power cord housing and is receivable in the depression in the second connection surface and a second retracted position. Biasing structure is provided for urging the first and second detent element toward their extended positions.

The temperature control device further includes a temperature sensor extending from the leading end thereof for sensing the temperature of the electrical appliance. In addition, first and second appliance terminals communicate with the leading end of the temperature control device. The trailing end of the temperature control device includes first and second power cord terminals. A thermally-responsive switch is operatively connected to the temperature sensor. The switch is movable between a closed position wherein the power cord terminals are electrically coupled to corresponding appliance terminals and an open position wherein the power cord terminals are electrically isolated from corresponding appliance terminals in response to the temperature sensed by the temperature sensor.

The power cord housing may include first and second power supply terminals communicating with the forward end thereof and interconnected to the power cord. The power supply terminals are connectable to the power cord terminals of the temperature control device. The first and second connection surfaces of the temperature control device are generally parallel to each other. The first and second detent element include ball bearings. In its extended position, the first detent element projects from the first surface of the power cord housing and is receivable in the depression in the first connection surface. In its extended position, the second detent element projects from the second surface of the power cord housing and is receivable in the depression in the second connection surface. The biasing structure includes a spring that extends between the first and second detent elements.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
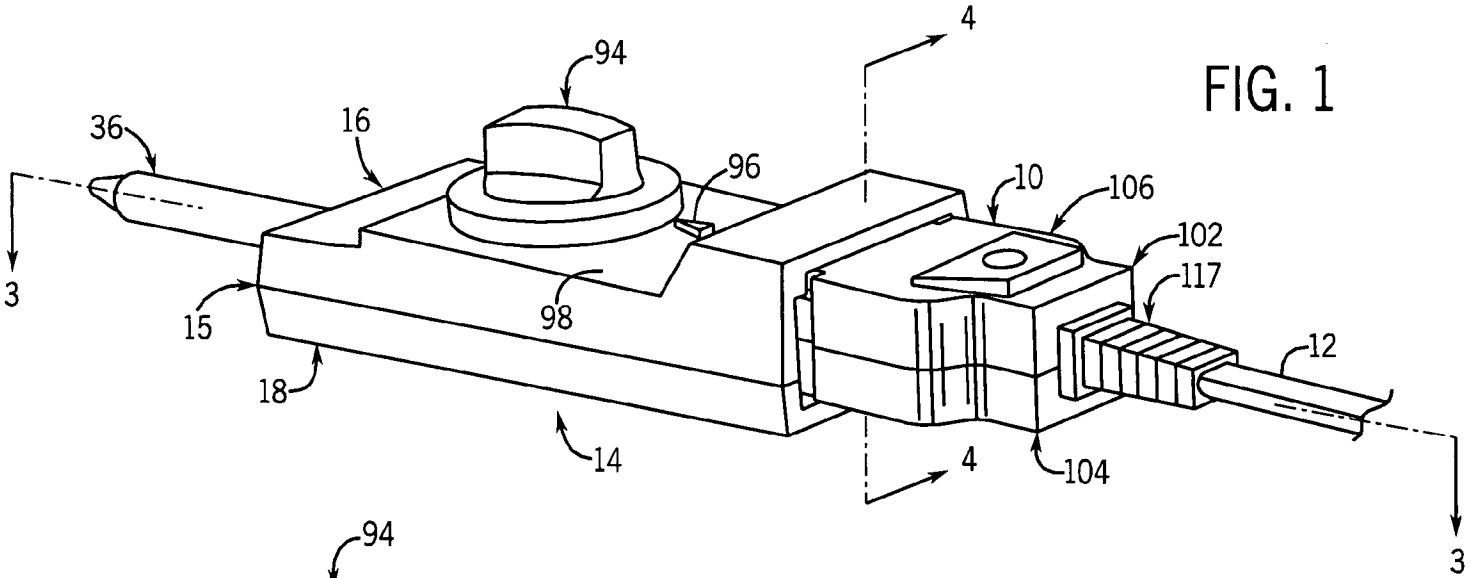
FIG. 1 is an isometric view of a detachable power cord apparatus in accordance with the present invention in a first, connected configuration.

Referring to FIGS. 1–5, a power cord apparatus in accordance with the present invention is generally designated by the reference numeral 10. By way of example, power cord apparatus 10 is utilized to interconnect power cord 12 to temperature control device 14. In addition, it is contemplated for power cord apparatus 10 to interconnect power cord 12 directly to an electrical appliance that does not incorporate temperature control device 14 without deviating from the scope of the present invention.

Temperature control device 14 includes housing 15 formed by upper and lower housing portions 16 and 18, respectively, interconnected in any conventional manner such as by screws 20 or the like. Housing 15 is defined by a generally flat lower wall 22 having an inner surface 24 and an outer surface 26. Housing 15 further includes first and second side walls 28 and 30, respectively, and end wall 32 interconnecting lower wall 22 and upper wall 38. End wall 32 includes a generally circular opening 34 therein for allowing temperature probe 36 to be inserted therethrough, for reasons hereinafter described. Upper wall 38 includes inner surface 44 that, along with and inner surface 24 of lower panel 22, partially defines cavity 46 in housing 15.

In its assembled configuration, housing 15 of temperature control device 14 includes first closed end 48 having temperature probe 36 extending through opening 34 in end wall 38 and second open end 50. Mounting panel 52 is positioned within cavity 46 of housing 15 adjacent open end 50 thereof. Mounting panel 52 has a generally rectangular configuration and includes first and second side walls 54 and 56. Side wall 54 of mounting panel 52 engages inner surface 28*a* of side wall 28 of housing 15. Similarly, side wall 56 is engageable with inner surface 30*a* of side wall 30 of housing 15. Mounting panel 52 further includes outer face 60 and inner face 62. Outer face 60 of mounting panel 52 is spaced from open end 50 of housing 15 of temperature control device 14 so as to define cavity 64 for receiving forward end 66 of power cord apparatus 10. Outer face 60 of mounting panel 52 further includes central recessed surface 68, for reasons hereinafter described.

Figure 4:
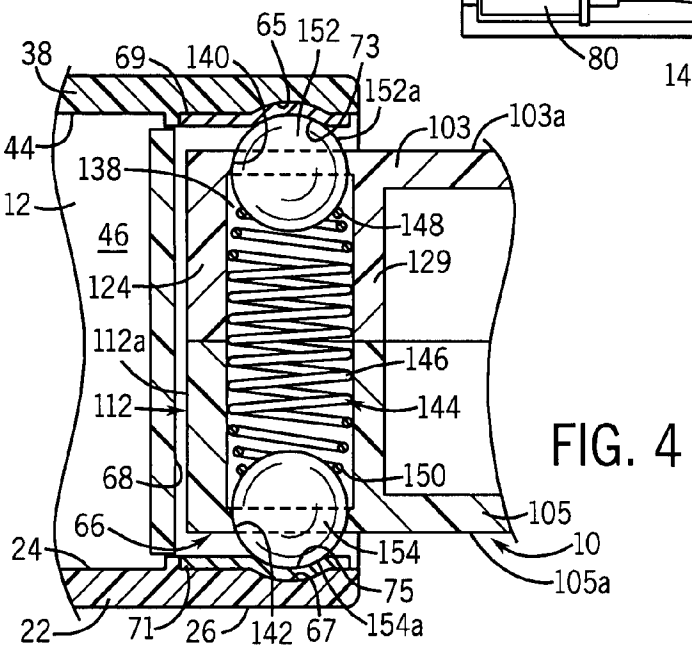
FIG. 4 is a cross-sectional view of the detachable power cord apparatus of the present invention taken along line 4—4 of FIG. 1.

As best seen in FIG. 4, inner surfaces 44 and 24 of upper and lower walls 38 and 22, respectively, include corresponding depressions 65 and 67, adjacent open end 50 of housing 15. Friction pads 69 and 71 may be affixed in any suitable manner to corresponding inner surfaces 44 and 24 of upper and lower walls 38 and 22, respectively, of housing 15 so as to overlap corresponding depressions 65 and 67, respectively. Friction pads 69 and 71 include corresponding depressions 73 and 75, respectively, that overlap depressions 65 and 67, respectively, in inner surfaces 44 and 24 of upper and lower walls 38 and 22, respectively, and that define catches, for reasons hereinafter described.

Figure 3:
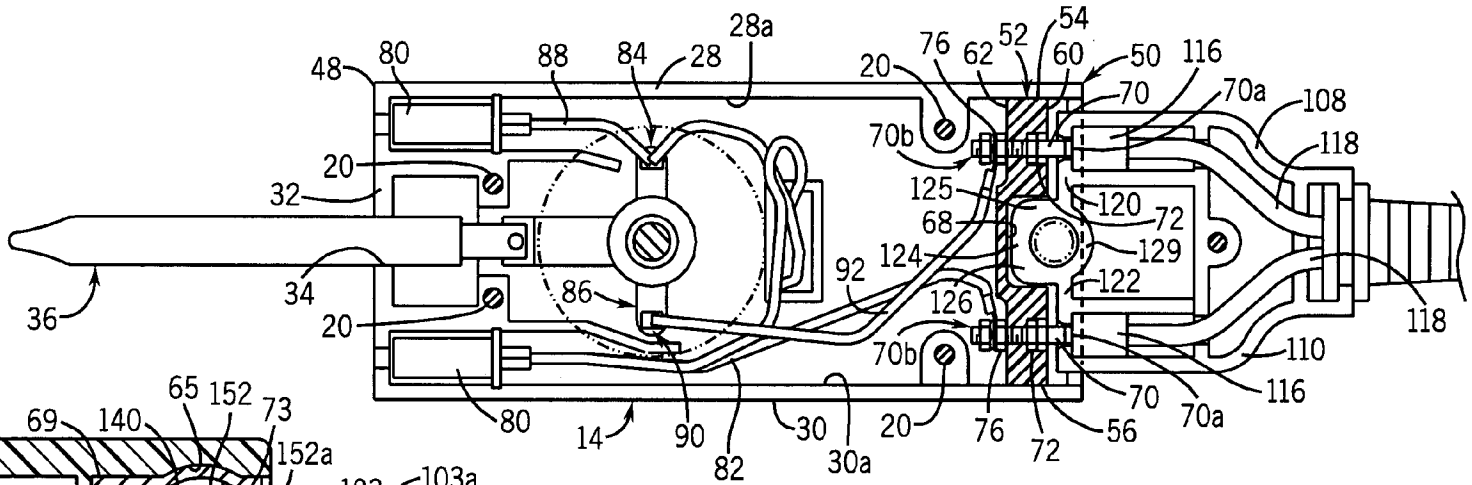
FIG. 3 is a cross-sectional view of the detachable power cord apparatus of the present invention taken along line 3—3 of FIG. 1.
Figure 5:
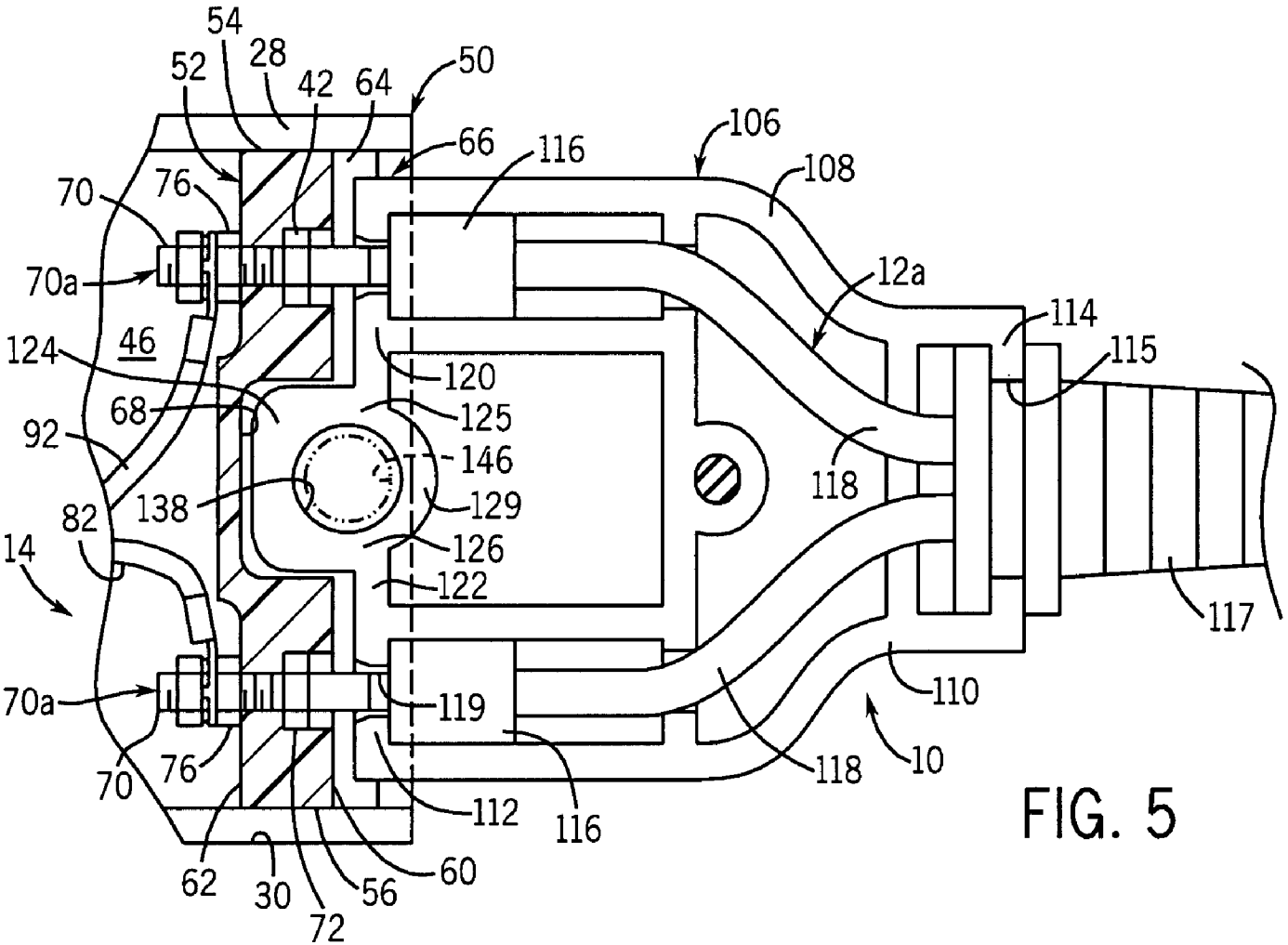
FIG. 5 is an enlarged, cross-sectional view of the detachable power cord apparatus of FIG. 3.

Temperature control device 14 further includes a pair of electrical contacts 70. Each contact 70 includes outer end 70*a* projecting from outer face 60 of mounting panel 52 and inner end 70*b* projecting from inner face 62 of mounting panel 52. Electrical contact 70 further includes radially extending flanges 72 projecting therefrom that are seated in corresponding recesses in outer face 60 of mounting panel 52. As best seen in FIGS. 3 and 5, nuts 76 threaded on inner ends 70*b* of electrical contacts 70 so as to capture mounting plate 52 between nuts 76 and corresponding flanges 72 thereby interconnecting electrical contacts 70 to mounting panel 52.

As best seen in FIG. 3, temperature control device 14 further includes a pair of conductive female receivers 80 positioned within housing 15 adjacent closed end 48 thereof. One of the female receivers 80 is interconnected to the inner end 70*b* of one of the contacts 70 by line 82. The other of the female receivers 80 is operatively connected to output 84 of thermally-responsive switch 80 by line 88. Input 90 of thermally-responsive switch 86 is electrically connected to inner end 70*b* of the other of the electrical contacts 70 by line 92. Thermally-responsive switch 86 is coupled to temperature probe 36 and to temperature control dial 94. As is conventional, indicia 96 is provided on upper surface 98 of upper wall 38 of housing 15 to cooperate with temperature dial 94 so as to allow a user to adjust the temperature of the electrical appliance upward or downward by rotation of temperature dial 94.

Power cord apparatus 10 is mounted to a first terminal end 12*a* of power cord 12. As is conventional, second end (not shown) of power cord 12 includes a standard electrical plug connected thereto. Power cord apparatus 10 includes upper and lower portions 102 and 104, respectively, that define housing 106. Housing 106 includes upper and lower walls 103 and 105, respectively, first and second side walls 108 and 110, respectively, and forward and rearward end walls 112, and 114, respectively. Opening 115 is provided in housing 106 to allow terminal end 12*a* of power cord 12 to be inserted therethrough. Flexible neck 117 extends about power cord 12 and is seated in opening 115 in housing 106 to maintain terminal end 12*a* of power cord 12 within housing 106. Power cord apparatus further includes female receptacles 116 having first ends communicating with openings 119 through forward end wall 112 and being adapted for receiving corresponding contacts 70 therein. In addition, female receptacles 116 are electrically coupled to corresponding polarized lines 118 of power cord 12.

Forward end wall 112 of power cord apparatus 10 includes first and second recessed portions 120 and 122, respectively, lying in a generally common plane. In addition, forward end wall 112 of power cord apparatus 10 further includes an extended portion 124 interconnecting to recessed portions 120 and 122 by side walls 125 and 126, respectively. In addition, first and second recess portions 120 and 122, respectively, are interconnected by generally arcuate inner wall 129. The inner surface of extended portion 124 of forward end wall 112, inner surfaces of side walls 125 and 126, and the inner surface of inner wall 129 define a generally cylindrical spring receiving passageway 138 extending between upper wall 103 and lower wall 105 of power cord apparatus 10. As best seen in FIG. 4, upper wall 103 includes aperture 140 therethrough that communicates with passageway 138 through power cord apparatus 10. In addition, lower wall 105 includes aperture 142 therethrough that communicates with passageway 138 through power cord apparatus 10. Apertures 140 and 142 are axially aligned with each other, for reasons hereinafter described.

Power cord apparatus 10 further includes detent arrangement 144 housed within passageway 138. Detent arrangement 144 includes spring 146 having first and second ends 148 and 150, respectively. Ball bearings 152 and 154 are positioned in passageway 138 through housing 106 and are seated on corresponding ends 148 and 150, respectively, of spring 146. It is noted that ball bearings 152 and 154 have diameters greater than the diameters of corresponding apertures 140 and 142, respectively, in housing 106 such that ball bearings 152 and 154 are retained in passageway 138. Ball bearing 152 is biased by spring 146 such that a portion of ball bearing 152 extends through aperture 140 in upper wall 103. Similarly, ball bearing is biased by spring 146 such that a portion of ball bearing 154 extends through opening 142 in lower ball 105. It can be appreciated ball bearings 152 are movable between an extended position, FIG. 4, wherein ball bearings 154 and 152 at 159 extend outwardly from corresponding apertures 140 and 142 in upper and lower walls 103 and 105, respectively, of housing 106 of power cord apparatus 10 and a retracted position wherein outer surfaces 152*a* and 154*a* of ball bearings 152 and 154, respectively, are generally co-planar with outer surfaces 103*a* and 105*a* of upper and lower walls 103 and 105, respectively, of housing 106.

Figure 2:
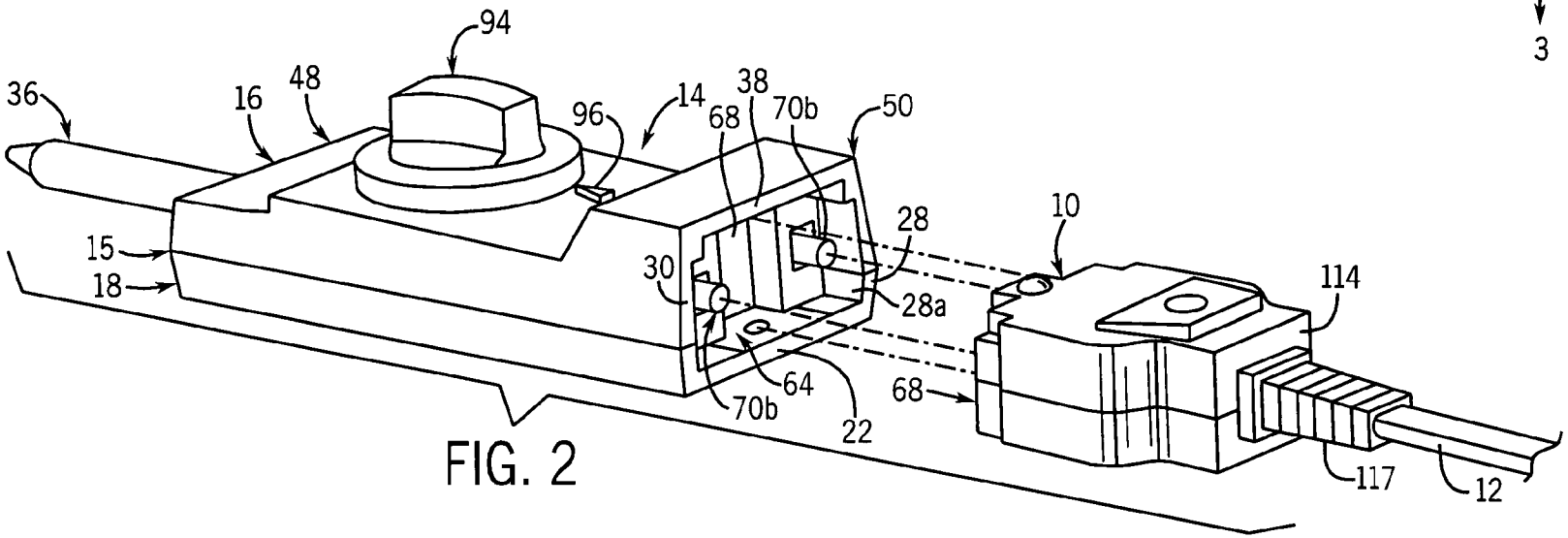
FIG. 2 is an isometric view of the detachable power cord apparatus of FIG. 1 in a second, disconnected configuration.

In operation, power cord apparatus 10 is axially aligned with open end 50 of housing 15 of temperature control device 14 such that outer face 112*a* of formed end wall 112 overlaps outer face 60 of mounting panel 52, FIG. 2. As power cord apparatus 10 is moved toward open end 50 of housing 15 of temperature control device 14, outer surfaces 152*a* and 154*a* of ball bearings 152 and 154, respectively, engage the inner surfaces of friction pads 69 and 71, respectively, so as to urge ball bearings 152 and 154 toward their retracted position. As the forward end of housing 106 of power cord apparatus 10 is further inserted into open end 50 of housing 15 of temperature control device 14, outer ends 70*a* of contacts 70 are received within corresponding female receptacles 116 in power cord apparatus 10 until such point as ball bearings 152 and 154 become seated in corresponding catches 73 and 75, respectively, in corresponding friction pads 69 and 71, respectively. With ball bearings 152 and 154 seated within corresponding catches 73 and 75, respectively, in friction pads 69 and 71, respectively, contacts 70 are electrically coupled to corresponding polarized wires 118 through female receptacles 116. As described, with contact 70 electrically connected to a power source through power cord apparatus 10, temperature control device 14 may be interconnected to an electrical appliance such that temperature control 36 is received within a temperature probe receiver of the electrical appliance and such that the power supply prongs of the electrical appliance are received within and electrically coupled to female receivers 80.

As is conventional, thermostat control dial 94 allows a user to set the temperature of the electrical appliance to a user-desired level. Temperature probe 36 monitors the temperature of the electrical appliance and closes switch 86 if the temperature drops below a user-desired level. With switch 86 in the closed position, both female receptacles 80 are electrically coupled to corresponding contacts 70, and hence, to a power source through power connector 10. As a result, the power input connectors on the appliance are electrically connected to the power source. In the event the temperature probe 36 senses that the temperature of the electrical appliance exceeds the user-desired level, the temperature probe 36 opens by switch 86 so as to disconnect the power input connectors on the appliance from the electrical power source.

In order to disconnect power cord 12 from temperature control device 14, a user may simply exert a predetermined shearing or lateral force on power connection apparatus 10 so as to urge ball bearings 152 and 154 into their retracted position and disengage from catches 73 and 75, respectively, in friction pads 69 and 71, respectively. The amount of shearing or lateral force needed to disconnect power cord connection apparatus 10 from temperature control device 14 is dependent upon the spring force generated by spring 146. It can be appreciated by increasing or decreasing the spring force of spring 146 (e.g. by replacing spring 146), the force required to urge ball bearings 152 and 154 to their retracted position can be adjusted.

Various modes of carrying out the invention are contemplated as being within the scope of the following claims particularly pointing out and distinctly claiming the subject matter which is regarded as the invention.

We claim:

1. A connection device for operatively connecting a temperature control housing of an electrical appliance to a power source, comprising:

upper and lower spaced connection surfaces projecting from the control housing and defining a cavity therebetween, the upper and lower connection surfaces include corresponding catches axially aligned with each other;

a power cord housing for supporting a first end of a power cord, the power cord housing having upper and lower surfaces, a passageway extending therethrough, and a forward end receivable between the upper and lower connection surfaces; and a first detent element movable between a first extended position wherein the first detent element projects from the power cord housing and is partially receivable in one of the catches and a second retracted position wherein the first detent element is received within the passageway through the power cord housing;

wherein one of the catches includes a fraction pad engageable with the first detent element.

2. The connection device of claim 1 wherein the first detent element includes a ball bearing.

3. The connection device of claim 1 wherein catch in the upper connection surfaces includes a depression for receiving the first detent element therein.

4. The connection device of claim 1 further comprising a second detent element movable between a first extended position wherein the second detent element projects from the power cord housing and is partically receivable in the other of the catches and a second retracted position wherein the second detent element is receivable within the passageway through the power cord housing.

5. The connection device of claim 4 wherein the first detent element in the extended position projects from the upper surface of the power cord housing and wherein the second detent element in the extended position projects from the lower surface of the power cord housing.

6. The connection device of claim 4 wherein the second detent element includes a ball bearing.

7. The connection device of claim 4 further comprising a means for biasing the first and second detent elements toward the extended positions, the means for biasing the first and second detent elements being positioned within the passageway through the power cord housing.

8. The connection device of claim 7 wherein the means for biasing the first and second detent elements includes a spring extending between therebetween.

9. A connection device for operatively connecting a temperature control housing for an electrical appliance to a power source, comprising:

first and second connection surfaces projecting from the control housing and partially defining a cavity, each connection surfaces including a corresponding depression therein;

a power cord housing for supporting a first end of a power cord, the power cord housing having first and second surfaces, a passageway extending through the power cord housing and having a first end communicating with the first surface of the power cord housing and a second end communicating with the second surface of the power cord housing, and a forward end receivable in the cavity;

a first detent element captured within the passageway through the power cord housing and being movable between a first extended position wherein the first detent element projects from the power cord housing and is partially receivable in the depression in the first connection surface and a second retracted position; and a second detent element captured within the passageway through the power cord housing and being movable between a first extended position wherein the second detent element projects from the power cord housing and is partially receivable in the depression in the second connection surface and a second retracted position.

10. The connection device of claim 9 wherein the first and second connection surfaces are generally parallel to each other.

11. The connection device of claim 9 wherein the first detent element includes a ball bearing.

12. The connection device of claim 11 wherein the second detent element includes a ball bearing.

13. The connection device of claim 9 wherein the first detent element in the extended position projects from the first surface of the power cord housing and wherein the second detent element in the extended position projects from the second surface of the power cord housing.

14. The connection device of claim 9 further comprising a means for biasing the first and second detent elements toward the extended positions, the means for biasing positioned within the passageway through the power cord housing.

15. The connection device of claim 14 wherein the means for biasing the first and second detent elements includes a spring extending therebetween.

16. A connection device for operatively connecting an electrical appliance to a power source, comprising:

a temperature control device having leading and trailing ends, the temperature control device having:

first and second connection surfaces projecting from the trailing end that partially defining a cavity, each connection surface including a corresponding depression therein;

a power cord housing for supporting a first end of a power cord, the power cord housing having first and second surfaces, a passageway through the power cord housing and having a first end communicating with the first surface of the power cord housing and a second end communicating with the second surface of the power cord housing, and a forward end receivable in the cavity partially defined by the connection surfaces of the temperature control device;

a first detent element captured within in the passageway through the power cord housing and being movable between a first extended position wherein the first detent element projects from the power cord housing and is receivable in the depression in the first connection surface and a second retracted position;

a second detent element captured within in the passageway through the power cord housing and being movable between a first extended position wherein the second detent element projects from the power cord housing and is receivable in the depression in the second connection surface and a second retracted position; and biasing structure receivable in the passageway through the power cord housing for urging the first and second detent elements toward the extended positions.

17. The connection device of claim 16 wherein the first and second connection surfaces are generally parallel to each other.

18. The connection device of claim 16 wherein the first detent element in the extended position projects from the first surface of the power cord housing and wherein the second detent element in the extended position projects from the second surface of the power cord housing.

19. The connection device of claim 16 wherein the biasing structure includes a spring extending between the first and second detent elements.

20. The connection device of claim 16 wherein the temperature control device includes:

a temperature sensor extending from the leading end thereof for sensing the temperature of the electrical appliance;

first and second appliance terminals communicating with the leading end thereof;

first and second power cord terminals communicating with the trailing end thereof; and a thermally-responsive switch operatively connected to the temperature sensor, the switch movable between a first closed position wherein the power cord terminals are electrically coupled to corresponding appliance terminals and an open position wherein the power cord terminals are electrically isolated from corresponding appliance terminals in response to the temperature sensed by the temperature sensor.

21. The connection device of claim 17 wherein the power cord housing includes first and second power supply terminals communicating with the forward end thereof and interconnected to the power cord, the power supply terminals connectable to the power cord terminals of the temperature control device.

22. The connection device of claim 16 wherein the first detent element includes a ball bearing.

23. The connection device of claim 22 wherein the second detent element includes a ball bearing.

* * * * *